US006736878B2

(12) United States Patent
Hein

(10) Patent No.: US 6,736,878 B2
(45) Date of Patent: May 18, 2004

(54) PRECIPITATOR EXTRACTION METHOD AND SYSTEM

(76) Inventor: Arthur G. Hein, 5274 Cliffridge Avenue, North Vancouver (CA), V7R 3V4

( * ) Notice: Subject to any disclaimer, the term of this patent is extended or adjusted under 35 U.S.C. 154(b) by 0 days.

(21) Appl. No.: 10/093,380

(22) Filed: Mar. 11, 2002

(65) Prior Publication Data

US 2002/0124724 A1 Sep. 12, 2002

Related U.S. Application Data

(60) Provisional application No. 60/275,538, filed on Mar. 9, 2001.

(51) Int. Cl.[7] ..... B03C 3/76

(52) U.S. Cl. ..... 95/74; 95/76; 95/78; 96/32; 96/43; 96/50

(58) Field of Search ..... 95/74, 78, 76, 95/57; 96/50, 43, 32

(56) References Cited

U.S. PATENT DOCUMENTS

| | | | | | |
|---|---|---|---|---|---|
| 3,509,695 | A | * | 5/1970 | Egan et al. | 96/18 |
| 3,733,785 | A | | 5/1973 | Gallaer | 96/64 |
| 4,481,017 | A | * | 11/1984 | Furlong | 95/74 |
| 4,695,297 | A | | 9/1987 | Hein | 96/32 |
| 5,961,693 | A | * | 10/1999 | Altman et al. | 95/78 |

* cited by examiner

*Primary Examiner*—Richard L. Chiesa

(57) ABSTRACT

An dry horizontal flow electrostatic precipitator wherein a portion of the gas flow passing through the precipitator is extracted from the upper portion of the casing, such extraction flow having a lower particle concentration than gas flow at the bottom portion of the casing due to re-entrainment. The extraction gas flow is extracted by a manifold positioned at the top of the casing.

15 Claims, 2 Drawing Sheets

VIEW A-A

PRECIPITATOR EXTRACTION METHOD AND SYSTEM

CROSS REFERENCE TO RELATED APPLICATIONS

This application claims priority from U.S. Provisional Application Ser. No. 60/275,538 filed on Mar. 9, 2001 by Arthur G. Hein, and the entire disclosure of this provisional application is expressly incorporated herein by reference.

NOTICE REGARDING COPYRIGHTED MATERIAL

A portion of the disclosure of this patent document contains material which is subject to copyright protection. The copyright owner has no objection to the facsimile reproduction by anyone of the patent document or the patent disclosure as it appears in the public Patent Office file or records but otherwise reserves all copyright rights whatsoever.

FIELD OF THE INVENTION

This invention relates generally to electrostatic precipitators and in particular to precipitators in which the gas flows horizontally through the precipitator.

DESCRIPTION OF PRIOR ART

The use of electrostatic precipitators to remove suspended particles (i.e. dust) from gas flows is a well-known art and dry horizontal flow precipitators are commonly in service for such application.

The treatment zone of a common dry horizontal flow precipitator typically consists of a plurality of high voltage electrodes and collecting electrodes arranged to form gas passages that run parallel to the gas flow. The electrodes are enclosed in a casing through which the gas flows. The electrodes collect dust from the gas flow and rapping systems are used to dislodge the dust from the electrodes, which then falls due to gravity to the bottom of the casing. The bottom of the casing is equipped with a dust removal system to discharge the collected dust.

The gas flow is supplied to the precipitator through an inlet nozzle that connects an inlet duct to the casing inlet face and the gas flow is exhausted from the precipitator through an outlet duct that connects the casing outlet face to an exhaust duct.

In prior art precipitators, all of the gas flow treated by the precipitator enters the precipitator at the inlet face, flows through the precipitator treatment zone, and leaves the precipitator at the outlet face.

Optimum performance had been previously associated with uniform gas flow through the treatment zone. Absolutely uniform flow is not achievable and the Institute of Clean Air Companies, an association that includes major suppliers of electrostatic precipitators and which was formed to encourage improvement of engineering and technical standards, updated and reissued their standard ICAC-EP-7 in January 1997 to specify uniformity within acceptable limits.

The mathematical analysis leading to the conclusion that uniform gas flow provides best performance is based on the assumption that at any point within the precipitator the dust concentration does not vary from the top to the bottom of the treatment zone. Standards calling for uniform gas flow are also based on this assumption. However, this assumption is not correct, as re-entrainment of falling dust causes an ever-increasing difference in the dust concentration at the bottom of the treatment zone relative to the top as the gas flows through the treatment zone, with the result that at the precipitator outlet face, the dust concentration in the gas flow leaving the lower part of the precipitator treatment zone is much higher than from the upper part.

This was recognized in U.S. Pat. No. 3,733,785 to Gallaer and U.S. Pat. No. 4,695,297 to Hein that describe controlled non-uniform gas flows that improve precipitator collection efficiency over the uniform flow model. In the devices described in these patents, the gas flow remains entirely contained in the treatment zone from the inlet face to the outlet face.

SUMMARY OF THE INVENTION

The present invention involves a significant departure from the accepted theory and practice of containing all of the gas flow entering the precipitator in the casing through the entire treatment zone and exhausting it all at the outlet face of the precipitator.

As the gas flow passes through the treatment zone, the dust concentration in the gas flow becomes lower and reaches an average exit concentration at the outlet face. However, the dust concentration in the gas flow at the top of the precipitator is much lower than that of the gas flow at the bottom (because of re-entrainment) and the upper gas flow becomes cleaner than the average exit concentration before it reaches the outlet face.

A precipitator according to the invention extracts a portion of the gas flow (herein referred to as the "extraction flow") from the main gas flow. The extraction flow is taken from the upper region of the treatment zone before the outlet face. The extraction flow can then be reintroduced to the remaining gas flow after the remaining gas flow passes through the outlet face.

This results in at least two benefits. First, extracting a portion of the gas flow from the top of the precipitator encourages the rise of the remaining gas flow as the remaining gas flow proceeds toward the outlet of the precipitator and thereby improves the efficiency of the precipitator upstream of the point of extraction by reducing re-entrainment. Second, the velocity of the remaining gas flow after the point of extraction is reduced as the volume of the gas flow has been reduced by the amount of the extraction flow. Precipitator performance depends on treatment time which is the length of time the gas flow is in the treatment zone. Reducing the velocity of the gas flow increases the treatment time and therefore raises the precipitator collection efficiency after the point of extraction of the extraction flow.

BRIEF DESCRIPTION OF THE DRAWINGS

Further objects, features and advantages of the present invention will become more readily apparent to those skilled in the art from the following description of the invention when taken in conjunction with the accompanying drawings, in which.

DESCRIPTION OF THE PREFERRED EMBODIMENTS

Figure 1:
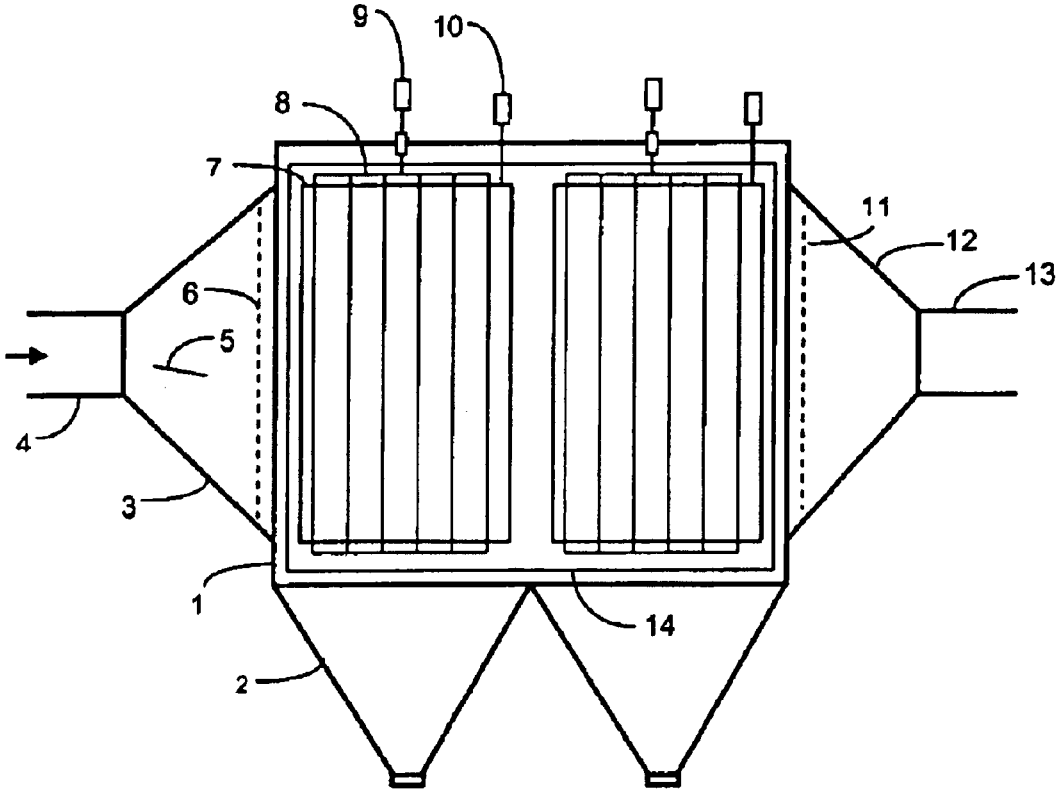
FIG. 1 PRIOR ART
FIG. 1 is a cross sectional side view of a dry horizontal flow electrostatic precipitator according to prior art.

As best seen in FIG. 1, the casing 1 of a dry horizontal flow precipitator, according to the prior art, encloses the electrode systems. Collecting electrodes 7 are spaced to form gas passages parallel to the gas flow. High voltage electrodes 8 are spaced in the gas passages between the collecting electrodes and are supported from insulators. The zone formed by the gas passages in which the gas flow is exposed to the influence of the high voltage and collecting electrodes is referred to as the treatment zone 14. Treatment zone 14 in FIG. 1 consists of two fields in the direction of gas flow. Each field has it's own electrical power supply. Large precipitators may have several electrical power supplies across the width of the precipitator as well as several in the direction of flow. The number of fields in a precipitator is measured by the number of power supplies in the direction of gas flow and varies from a single field to a plurality of fields. The bottom of the casing is equipped with a dust removal system, which may be a hopper system 2 as shown in FIG. 1 or may be another system such as a drag conveyor or wet sluicing. Collected dust is dislodged from the electrodes by high voltage system rappers 9 and collecting system rappers 10, which may either be positioned externally to the casing as shown, or positioned inside the casing.

Gas is introduced to the precipitator through inlet duct 4, to inlet nozzle 3. The desired gas flow distribution across the precipitator inlet face is accomplished with vanes and diffuser screens 5, 6 that are positioned in the inlet nozzle 3 and at the precipitator inlet face. Gas is exhausted from the precipitator through an outlet diffuser screen 11 to an outlet nozzle 12 and an outlet duct 13.

Figure 2:
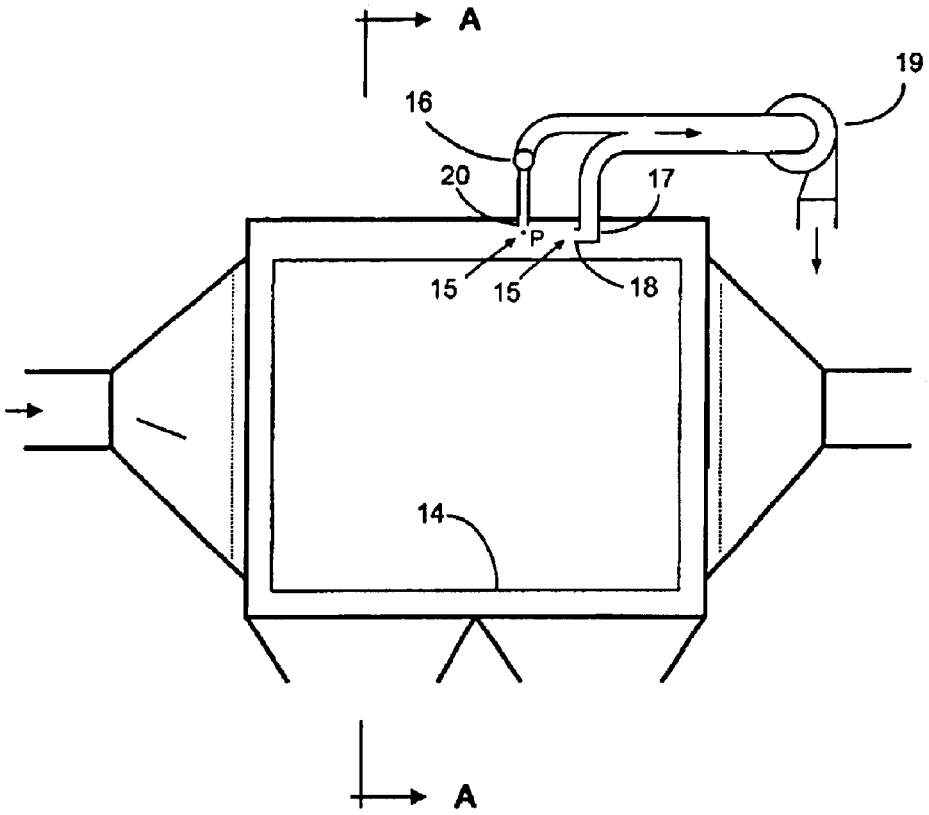
FIG. 2 is a cross sectional side view of an extraction system according to a preferred embodiment of the invention.
Figure 3:
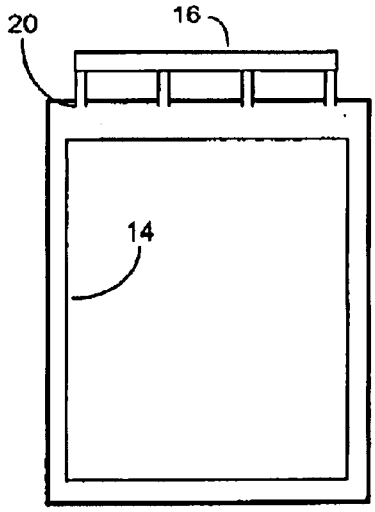
FIG. 3 is a cross sectional view thereof taken along the lines A—A in FIG. 2.
Figure 4:
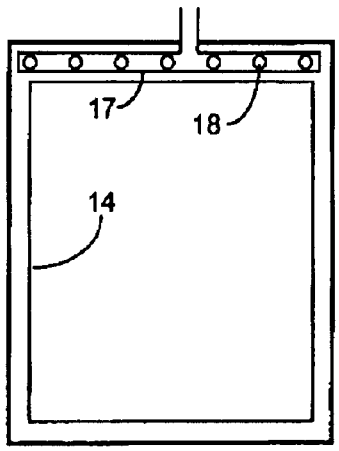
FIG. 4 is a cross sectional view of an alternative embodiment of a precipitator according to the invention.

As best seen in FIG. 2, a precipitator according to the invention, extracts the extraction flow 15 from the upper region of the casing at one or more locations in casing 1. The precipitator shown in FIG. 2 shows two such locations. At each location a manifold is utilized to gather extraction gas flow across the width of the precipitator from the space above a precipitator field or from the space between precipitator fields. The manifold 16 may be external to the precipitator casing 1 as shown in FIG. 3 or manifold 17 may be positioned inside casing 1 as shown in FIG. 4. The extraction flow is preferably introduced back into the main gas flow after it leaves the precipitator outlet face or alternatively, is exhausted elsewhere. Fan 19 is used to assist in extracting the extraction flow, but there may be sufficient pressure available to remove the extraction flow without a fan.

As further shown in FIG. 2, exhaust ports 18 and 20 are located at positions in the casing. At least one exhaust port 20, for example, creates a point of extraction P spaced a predetermined distance from the inlet, for first extracting the extraction gas flow when the gas flow in the upper portion of the casing contains a predetermined level of dust concentration. Note that such a location is the first point of extraction, i.e., the location where gases are first extracted from the casing such that gases are not extracted in front of or before reaching the point of extraction P. Thus, only gases which have been first sufficiently treated by the precipitator and have a lower dust concentration are extracted through the exhaust ports 18 and 20.

In operation, the gas flow in the upper portion of the treatment zone is less susceptible to the re-entrainment of falling dust. This causes such upper gas flow to have a lower dust concentration than the lower gas flow as the gas flow progresses through the treatment zone. At the point that the upper gas flow reaches a desired level of dust concentration, the extraction flow is extracted from the precipitator allowing the remaining gas flow to pass through the remaining portion of the treatment zone with a slower velocity. This allows the remaining gas flow in the precipitator to spend more time in the treatment zone, causing lower levels of dust concentration when the remaining flow reaches the outlet nozzle. The remaining gas flow is also pressured upwards, making such gas flow less susceptible to re-entrainment. Therefore a precipitator according to the invention is more efficient than a standard horizontal flow precipitator.

Many prior art precipitators have aisles between the fields that are designed to give access to the electrodes and rapping systems. The space at the top of these aisles is often not important for access and would then be available for installing a manifold which could exhaust either through the top of the casing as shown in FIG. 4 or through the sidewall of the precipitator casing at the end of the manifold. Therefore, existing precipitators can be easily modified to perform according to the invention.

While the principles of the invention have now been made clear in the illustrated embodiments, it will be immediately obvious to those skilled in the art that many modifications may be made of structure, arrangements, and algorithms used in the practice of the invention, and otherwise, which are particularly adapted for specific environments and operational requirements, without departing from those principles. The claims are therefore intended to cover and embrace such modifications within the limits only of the true spirit and scope of the invention.

I claim:

1. A dry horizontal flow electrostatic precipitator for removing suspended particles from a gas flow, the precipitator comprising:

a casing;

a treatment zone comprising electrodes;

rapping means to dislodge the collected dust;

an inlet and an outlet; and extraction means having an exhaust port for withdrawing an extraction gas flow from the upper portion of the casing prior to the gas flow reaching the outlet, wherein said exhaust port is located at a position in the casing for creating a point of extraction spaced a single predetermined distance from said inlet, for first extracting the extraction gas flow when the gas flow in the upper portion of the casing contains a predetermined level of dust concentration, and wherein said point of extraction is spaced at a distance from said inlet which is greater than half the distance between said inlet and said outlet.

2. The precipitator of claim 1, wherein the extraction flow is reintroduced to the remaining gas flow after the remaining gas flow has passed through the outlet.

3. The precipitator of claim 1, wherein the extraction means comprises a manifold.

4. The precipitator of claim 3, wherein said manifold is positioned within the casing.

5. The precipitator of claim 3, wherein said manifold is positioned external to the casing.

6. The precipitator of claim 3, wherein said manifold comprises a plurality of exhaust ports, said exhaust ports creating plural points of extraction each of which is spaced at a distance from said inlet which is greater than half the distance between said inlet and said outlet.

7. The precipitator of claim 1, wherein the extraction means further comprises a fan.

8. A method of extracting particles from a gas flow comprising the steps of:

introducing the gas flow to a casing through an inlet;

treating said gas flow with electrodes to remove said particles;

providing a point of extraction spaced a single predetermined distance from said inlet, for first extracting an extraction gas flow when the gas flow in the upper portion of the casing contains a predetermined level of dust concentration;

extracting the extraction gas flow from the upper portion of said casing at said point of extraction; and removing the remaining gas flow from the casing through an outlet, wherein said point of extraction is spaced at a distance from said inlet which is greater than half the distance between said inlet and said outlet.

9. The method of claim 8, wherein a manifold extracts said extraction gas flow.

10. The precipitator of claim 9, wherein said manifold comprises a plurality of exhaust ports, said exhaust ports creating plural points of extraction each of which is spaced at a distance from said inlet which is greater than half the distance between said inlet and said outlet.

11. The method of claim 9, wherein the extraction gas flow is reintroduced to the remaining gas flow after the remaining gas flow has been removed from the casing.

12. The method of claim 11, wherein the manifold is positioned within the casing.

13. The method of claim 11, wherein the manifold is external to the casing.

14. A method of modifying a dry horizontal flow electrostatic precipitator for removing dust particles from a gas flow, the precipitator comprising a casing, an inlet, an outlet, and at least two treatment fields having an aisle between the fields and the top of the casing, comprising the steps of:

installing a manifold in said aisle to extract an extraction flow from the gas flow; and providing a point of extraction spaced a single predetermined distance from said inlet, for first extracting an extraction gas flow when the gas flow in the upper portion of the casing contains a predetermined level of dust concentration, wherein said point of extraction is spaced at a distance from said inlet which is greater than half the distance between said inlet and said outlet.

15. The precipitator of claim 14, wherein said manifold comprises a plurality of exhaust ports, said exhaust ports creating plural points of extraction each of which is spaced at a distance from said inlet which is greater than half the distance between said inlet and said outlet.

* * * * *